US005152077A

United States Patent [19]

Liang

[11] Patent Number: 5,152,077

[45] Date of Patent: Oct. 6, 1992

[54] CLOTH DRYING MACHINE

[76] Inventor: Chao-Jung Liang, No. 75, Long Chang Road, I-Lan, Taiwan

[21] Appl. No.: 745,802

[22] Filed: Aug. 16, 1991

[51] Int. Cl.[5] ..... F26B 21/06

[52] U.S. Cl. ..... 34/77; 34/219; 34/151; 34/44; 34/225

[58] Field of Search ..... 34/225, 201, 202, 218, 34/219, 76, 77, 233, 151, 44, 48, 53, 54, 55, 196

[56] References Cited

U.S. PATENT DOCUMENTS

| | | | |
|---|---|---|---|
| 2,232,022 | 2/1941 | Drake | 34/76 |
| 3,670,425 | 6/1972 | Benjamin et al. | 34/151 |
| 3,739,487 | 6/1973 | Clark | 34/77 |
| 3,805,561 | 4/1974 | Bullock | 34/151 |
| 4,180,919 | 1/1980 | Baltes | 34/151 |
| 4,471,537 | 9/1984 | Meda | 34/77 |
| 4,625,432 | 12/1986 | Baltes | 34/202 |
| 4,682,424 | 7/1987 | Irving | 34/202 |
| 4,869,872 | 9/1989 | Baltes | 34/77 |

*Primary Examiner*—Henry A. Bennet
*Assistant Examiner*—Denise L. F. Gromada
*Attorney, Agent, or Firm*—Lowe, Price, LeBlanc & Becker

[57] ABSTRACT

A clothes drying machine comprising a housing having a drying chamber at the top thereof for drying the clothes hung therein, and an installation chamber at the bottom into which two air fans and a compressor-operated heat exchanger circulation coil are installed to produce heated convection currents circulating through said drying chamber and said installation chamber to an exhaust wherein moisture is carried out of the housing of the machine and thereby permitting dry, hot air currents to be continuously delivered into said drying chamber to dry clothes hung therein.

3 Claims, 6 Drawing Sheets

CLOTH DRYING MACHINE

BACKGROUND OF THE INVENTION

The present invention relates to a clothes drying machine and relates more particularly to a clothes drying machine which produces heated convection currents to quickly dry the clothes hung therein.

Conventionally, after washing, clothes are hung on a rod or supporting rope for drying in the sun or by air. This natural drying process takes too long. During raining days when the air has a high percentage of water moisture therein, wet clothes may not dry. In recent years, several drying machines and fully automatic type of washing machines have been disclosed for drying or washing and drying clothes efficiently. The common disadvantage of the known types of drying machines and fully automatic type of washing machines is that the clothes which are dried can not be kept in shape and may be torn easily during the drying process. Another disadvantage of the known structures of drying machines and fully automatic type of washing machines is that colors may run during the drying process. Further, cotton lint may be discharged into the air during the operation of the machines, causing air contamination problems.

SUMMARY OF THE INVENTION

The present invention is intended to eliminate the aforesaid problems It is therefore an object of the present invention to provide a clothes drying machine which keeps clothes from stretching during the drying operation.

It is another object of the present invention to provide a clothes drying machine which keeps the colors in clothes from running.

It is still another object of the present invention to provide a clothes drying machine which does not cause air pollution problems.

According to the present invention, a clothes drying machine comprises an enclosed housing having means to produce heated convection currents, permitting moisture to be carried out of a drying chamber into a condensing compartment where moisture is condensed into water and then delivered to an evaporating compartment for evaporating into steam, the steam is then blown into a reheating compartment and dried by an electric heater. Therefore, hot, dry air is continuously delivered to the drying chamber to dry clothes hung therein.

DETAILED DESCRIPTION OF THE PREFERRED EMBODIMENT

Figure 1:
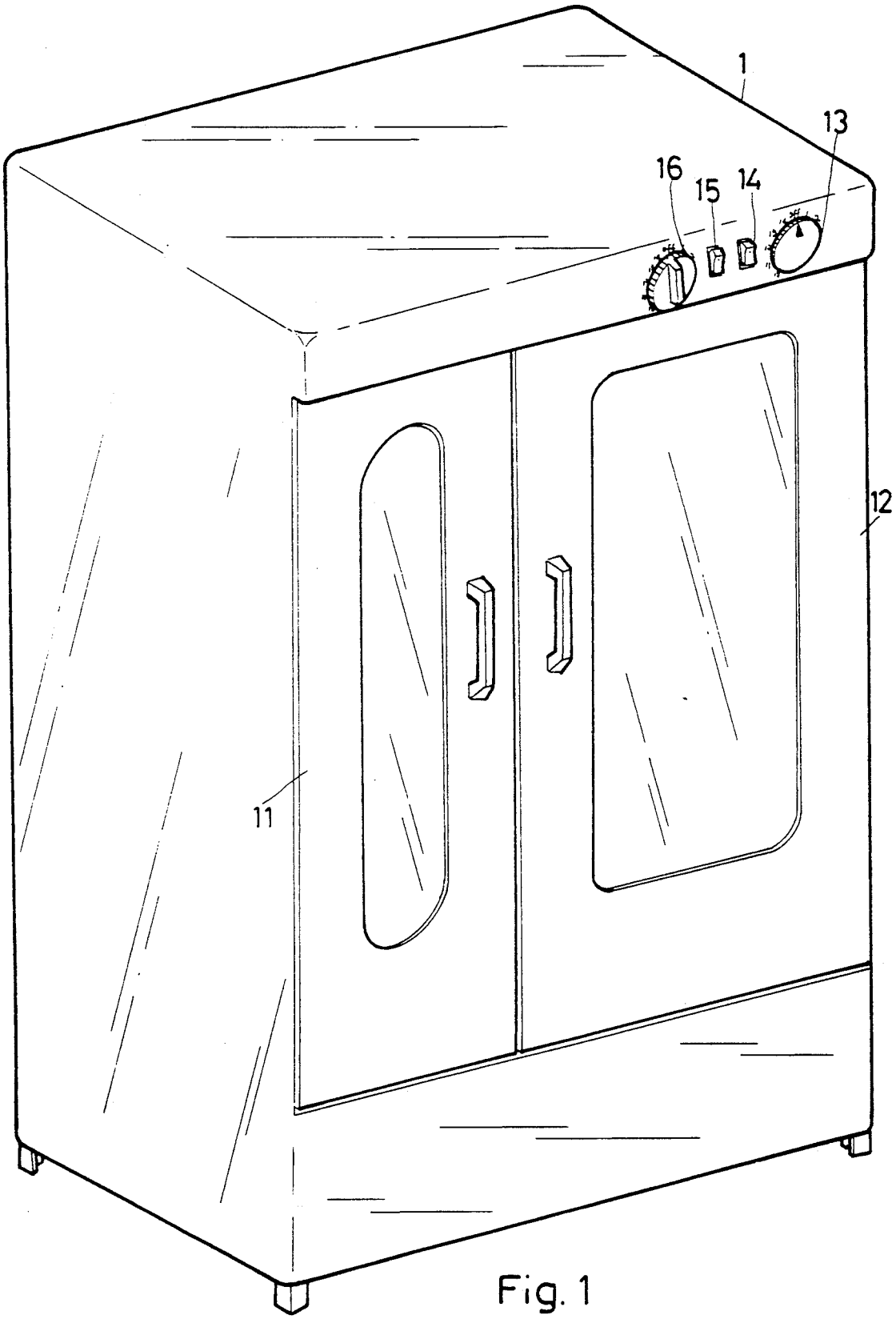
FIG. 1 is a perspective view of the preferred embodiment of the clothes drying machine of the present invention.
Figure 2:
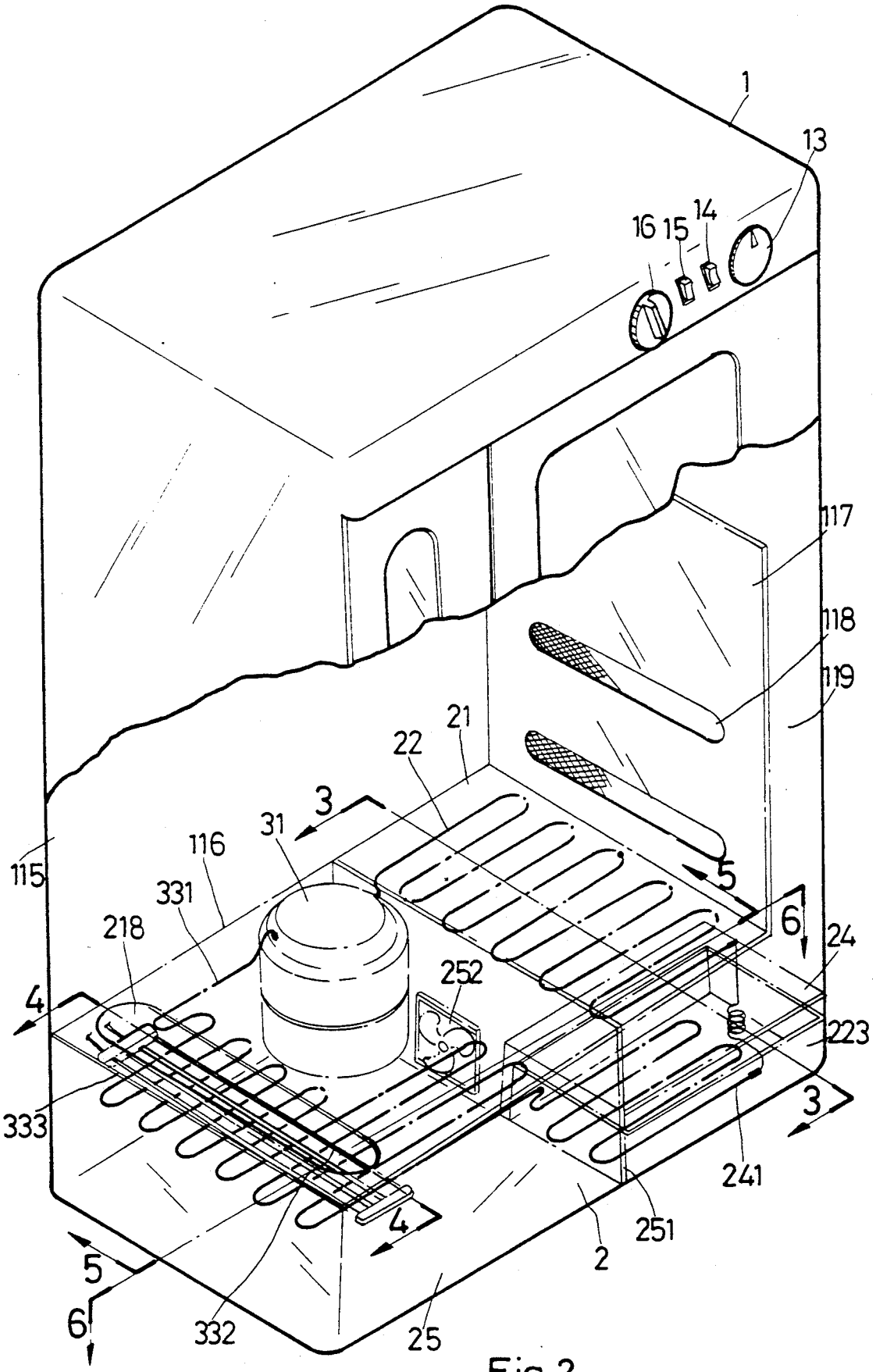
FIG. 2 is a view similar to FIG. 1 but with portions of the housing removed.

Referring to FIGS. 1 and 2, there is illustrated the preferred embodiment of the clothes drying machine of the present invention which is generally comprised of a housing 1 having double swinging doors 11, 12 on the front face thereof for access. On the front face of the housing 1 at the top, there are provided a timer 13, an ultra violet lamp control switch 14, an electric heater control switch 15, and a thermostat control switch 16.

Figure 3:
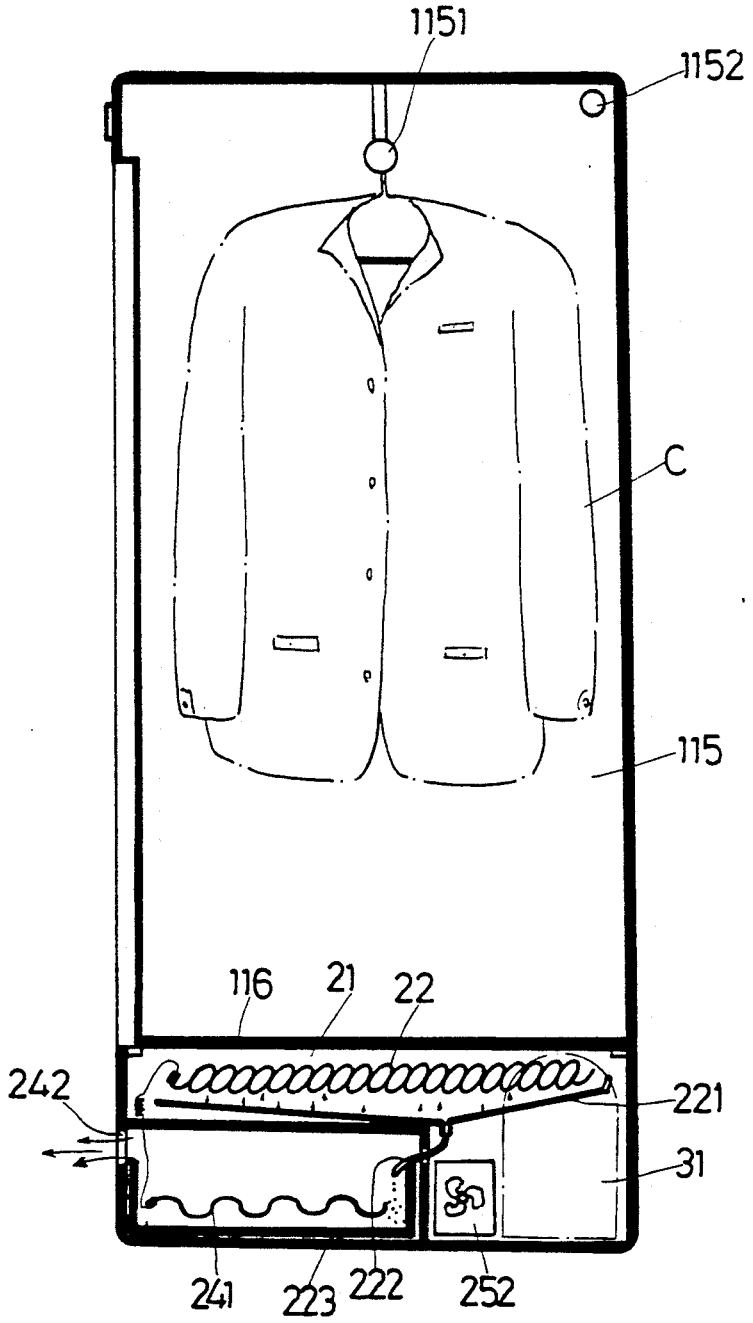
FIG. 3 is a longitudinal sectional view taken along line 3—3 of FIG. 2.
Figure 4:
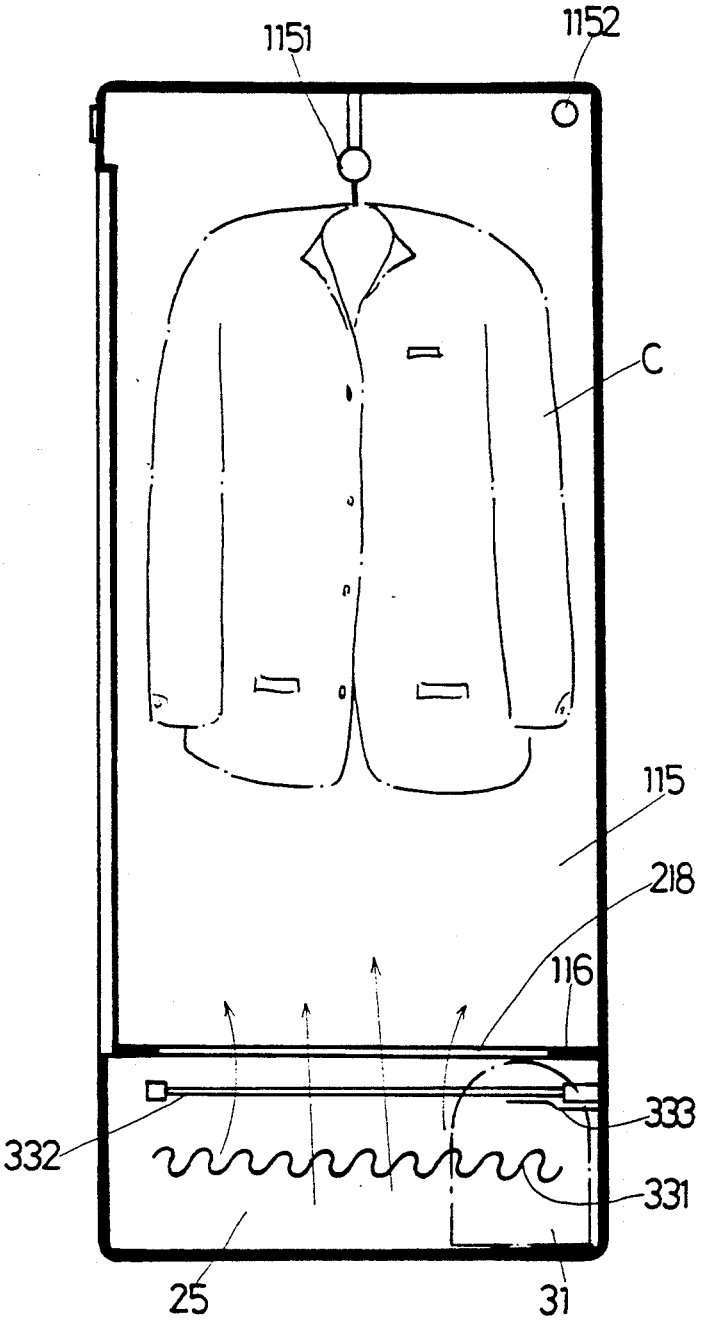
FIG. 4 is a longitudinal sectional view taken along line 4—4 of FIG. 2.
Figure 5:
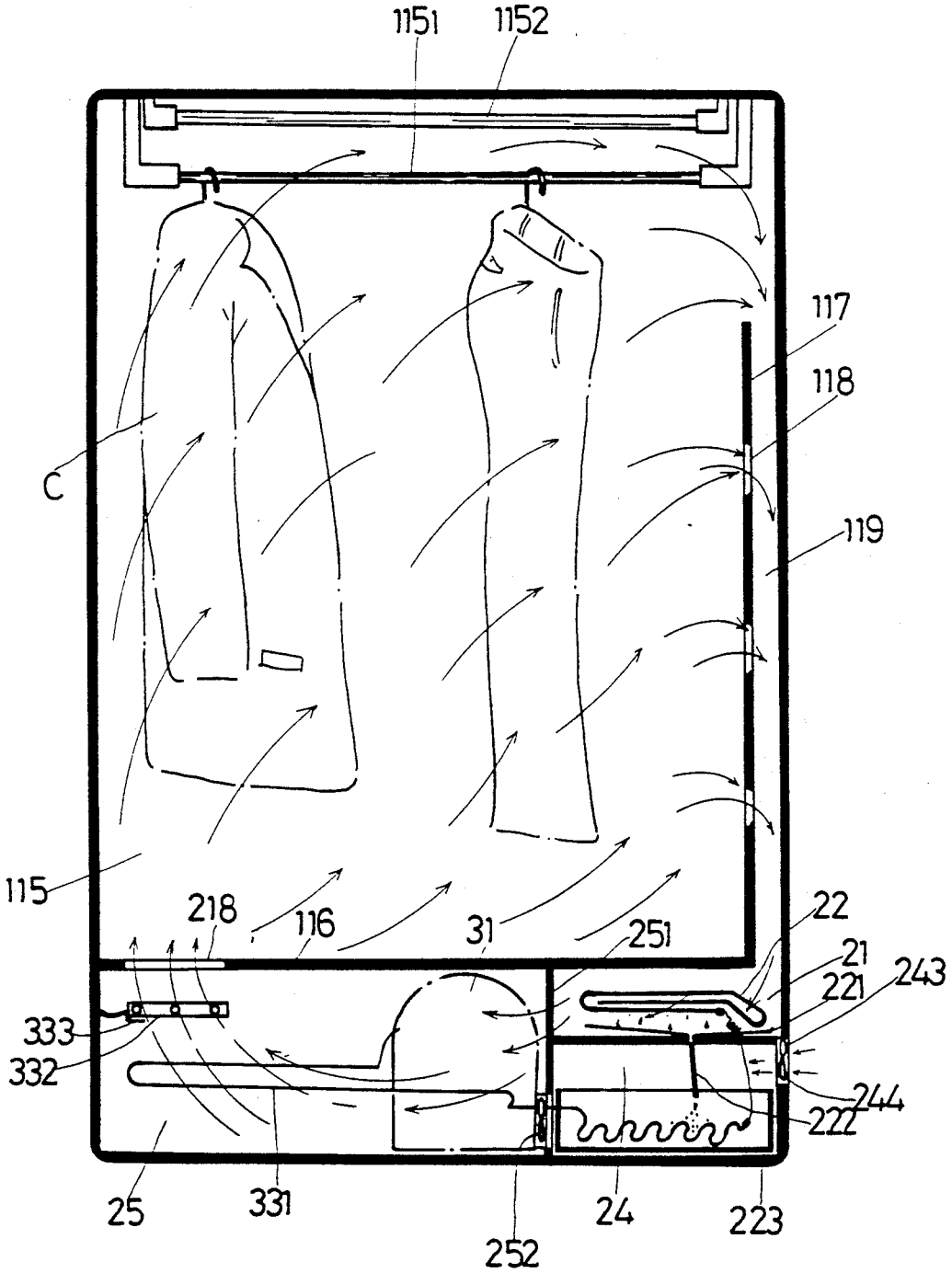
FIG. 5 is a transverse sectional view taken along line 5—5 of FIG. 2.
Figure 6:
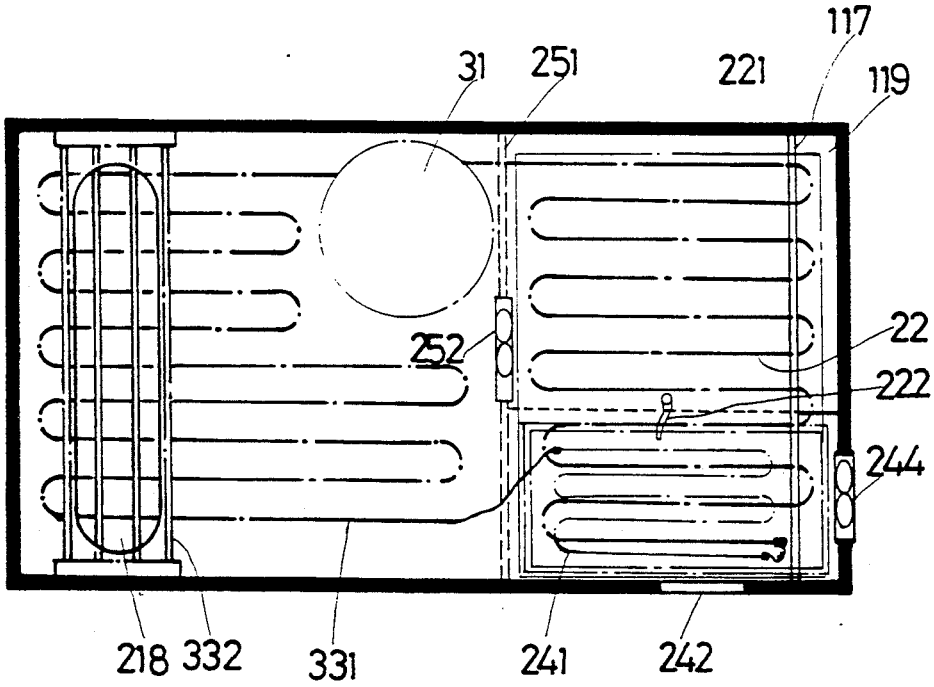
FIG. 6 is a sectional top view of the clothes drying machine of the present invention.

Referring to FIG. 3, as well as FIG. 2, a division plate 116 is transversely fastened inside the housing 1 to separate the holding space therein into a drying chamber 115 at the top and an installation chamber 2 at the bottom, which division plate 116 has one end attached to the inner wall surface of the housing 1 and an opposite end incorporated with a vertical board 117 which defines with the inner wall surface of the housing 1 a narrow air passage way 119 therebetween. The installation chamber 2 comprises a condensing compartment 21 at one end adjacent the narrow air passage way 119 for mounting a condensing coil 22 and a basin 221. Any water contained in the basin 221 is further guided through a guide tube 222 to a water container 223 which is fastened in a water evaporating compartment 24 inside the installation chamber 2. There is also provided an air condenser 31 fastened in the installation chamber 2 at a suitable location. The compressor 31 has one end connected to the condensing coil 22 and an opposite end connected to a heat releasing coil 241 via a radiating coil 331, wherein the condensing coil 22, the heat releasing coil 241 and the radiating coil 331 form a circulation coil, and the heat releasing coil 241 is disposed in the water container 223. The water evaporating compartment 24 has an exhaust hole 242 on the front end thereof for the exhaustion therethrough of steam, and an air intake hole 243 at one lateral side with an electric fan 244 mounted thereon. Inside the installation chamber 2 there is provided a re-heating compartment 25 adjacent the condensing compartment 21 and the evaporating compartment 24 and separated therefrom by a vertical division board 251. An air fan 252 is fastened inside the re-heating compartment 25 to such air currents from the condensing compartment 21 into the re-heating compartment 25 for evaporating. The compressor 31 is installed inside the re-heating compartment 25. There is a radiating coil 331 disposed in the re-heating compartment 25 at a lower level, an electric heater 332 is disposed above said radiating coil 331, and a thermostat 333 is attached to said electric heater 332 at the bottom. Further, the division plate 116 has an opening 218 made at a location corresponding to the electric heater 332.

In the drying chamber 115, there is provided a hanging rod 1151 for hanging clothes C and an ultra violet lamp 1152 above said hanging rod 1151 for sterilizing the clothes C hung therein.

When the machine is started, the air compressor 31 is turned on, and the condensing coil 22 in the condensing compartment 21 becomes cold. At the same time, the heat releasing coil 241 in the water container 223 and the radiating coil 331 in the re-heating compartment 25 are heated. Under this stage and by means of the operation of the air fan 252, moisture in the drying chamber 115 is carried by air currents which are sucked through a plurality of holes 118 in the vertical board 117 and the narrow passage way 119 into the condensing compartment 21. Water condensed therein will be gathered in the basin 221 and then guided by the guide tube 22 to the water container 223. By heating the heat releasing coil 241, any water in the water container 223 will be evaporated and exhausted through the exhaust hole 242. Dehumidified air currents are sucked, by means of the fan 252, from the condensing compartment 21 into the re-heating compartment 25 and heated by the radiating coil 331. During heat exchange between the radiating coil 331 and dehumidified air currents, the radiating coil 331 is simultaneously cooled, and therefore, the condensing coil 22 can be constantly maintained at a low temperature. Dry and hot air currents flow from the re-heating compartment 25 through the opening 218 on the division plate 116 toward the clothes C hanging in the drying chamber 115 to entrain moisture toward the narrow air passage way 119 for next circulation cycle. The aforesaid air circulation cycle is repeated until all the clothes C hung in the drying chamber 115 are dried.

For quick drying operation, the electric heater 332 may be turned on by means of electric heater control switch 15 to produce heat so as to accelerate the clothes drying operation. Further, turning on the ultra violet lamp control switch 14 causes the ultra violet lamp 1152 to produce ultra violet radiation for sterilizing the clothes hung in the drying chamber 115.

I claim:

1. A clothes drying machine comprising:

a hollow housing having double swinging doors on the front face thereof for access to the interior thereof, an air intake at one side, and an exhaust port at another side, a division plate therein forming a drying chamber at the top thereof for drying clothes hung therein and an installation chamber at the bottom thereof, said division plate having an opening at one end and a vertical board attached thereto at an opposite end, said vertical board having a plurality of openings thereon and defining with the housing a narrow air passage way therebetween, a plurality of division boards disposed in said installation chamber dividing it into a condensing compartment and an evaporating compartment at one side and a re-heating compartment at an opposite side;

a compressor mounted in said heat releasing compartment;

a condensing coil mounted in said condensing compartment, said condensing coil having an input port connected to said compressor and an output port at an opposite end inserted into said evaporating compartment;

a basin disposed in said condensing compartment below said condensing coil to collect condensed water drops;

a water container fastened in said evaporating compartment to collect water from said basin through a guide tube connected therebetween;

a heat releasing coil disposed in said evaporating compartment to release heat for evaporating the water gathered in said water container, said heat releasing coil having one end connected to said condensing coil and an opposite end inserted into said re-heating compartment;

a radiating coil disposed in said re-heating compartment, said radiating coil having one end connected to said air compressor and an opposite end connected to said heat releasing coil to incorporate said heat releasing coil and said condensing coil into a heat exchange circulation coil;

a first air fan means mounted in said air intake in said housing for bringing in outside air;

a second air fan means mounted between said condensing compartment and said re-heating compartment for conveying air currents from said condensing compartment into said re-heating compartment;

an electric heater mounted in said re-heating compartment;

a thermostat disposed below said electric heater;

timer means mounted on said housing at the front face thereof for automatically starting and stopping the operation of said compressor and said first and second air fan means at predetermined times;

a first control switch means mounted on said housing at the front face thereof for controlling the operation of said electric heater; and a second control switch means mounted on said housing at the front face thereof for regulating the setting of said thermostat.

2. The clothes drying machine of claim 1, further comprising an ultra violet lamp mounted in said drying chamber and third control switch means mounted on said housing at the front face thereof controlling said lamp for sterilizing the clothes hung in said drying chamber.

3. The drying machine of claim 1, wherein said compressor and said first and second air fan means are operable to cause convection currents of air to circulate through said drying chamber and said installation chamber permitting moisture to be carried from said drying chamber into said evaporating compartment for evaporation and also into said re-heating compartment for drying so that dry hot air is continuously delivered into said drying chamber to dry the clothes hung therein.

* * * * *